United States Patent [19]

Snyder et al.

[11] 4,244,510

[45] Jan. 13, 1981

[54] BUCKET-LIKE CARTON

[75] Inventors: Robert G. Snyder; Rohe D. Jack, Jr., both of Norway, Me.

[73] Assignee: Engineering Industries, Inc., Norway, Me.

[21] Appl. No.: 41,687

[22] Filed: May 23, 1979

[51] Int. Cl.[3] ..... B65D 13/00; B65D 5/72; B65D 5/64

[52] U.S. Cl. ..... 229/52 AL; 229/23 BT; 229/37 R; 229/41 C

[58] Field of Search ..... 229/23 BT, 41 C, 5.5, 229/37 R, 39, 52 AM, 52 AL, 52 AC, 24, 25, 26

[56] References Cited

U.S. PATENT DOCUMENTS

| | | | |
|---|---|---|---|
| 2,424,277 | 7/1947 | Klein | 229/52 AM |
| 2,511,317 | 6/1950 | Arneson | 229/52 AW |
| 2,596,087 | 5/1952 | Shoudy | 229/39 R |
| 3,032,254 | 5/1962 | Wilson | 229/41 C X |
| 3,189,249 | 6/1965 | Fallert | 229/37 R |
| 3,190,533 | 6/1965 | Larson | 229/37 R X |
| 4,091,984 | 5/1978 | McFarland | 229/23 BT |
| 4,166,568 | 9/1979 | Swan | 229/41 C X |

FOREIGN PATENT DOCUMENTS

| | | | |
|---|---|---|---|
| 560549 | 4/1957 | Italy | 229/52 AC |

*Primary Examiner*—Davis T. Moorhead
*Attorney, Agent, or Firm*—Hamilton, Brook, Smith & Reynolds

[57] ABSTRACT

A bucket-like carton has a polygonal cross section and a flexible bail is connected to handle hinges extending from the upper rim of the carton. An outer wall and an inner reinforcing wall forming the sides of the carton are stamped from a single sheet of corrugated board and are joined by the handle hinges. Tabs on the outer wall fold inwardly to overlap the inner wall. The wall tabs also overlap similar tabs extending outwardly from a recessed bottom and a recessed lid. The several layers of cardboard are stapled at both the top and bottom of the carton. The resultant sturdy carton provides the convenience of a bucket and has high strength at a low cost.

9 Claims, 25 Drawing Figures

BUCKET-LIKE CARTON

DESCRIPTION

Technical Field

This invention relates to cartons and has particular application to carrying and dispensing large amounts of heavy material.

BACKGROUND ART

The most widely used driveway sealer is a thick black emulsion. It is generally sold retail in large 50 pound metal or plastic buckets with lids and bails. Buckets are used because of of the convenience in handling provided by the bail. Also, buckets provide reasonable stacking strength and resist blows from the side. However, the rims of buckets are easily crushed when dropped at an angle. This is a particular problem when attempting to carry heavy fluids such as 50 pounds of driveway sealer. When a rum of a bucket is crushed, the bucket not only loses its stacking ability, but is also subject to leakage of the sealer. Other disadvantages of conventional buckets include the cost of metal or plastic and the cost of forming the buckets.

Because corrugated cartons are generally less expensive than metal buckets and the like, the use of such cartons has a distinct cost advantage. However, prior attempts to use cartons to carry heavy fluids such as driveway sealer have not been successful. The major problem has been in providing a carton which provides the convenience in handling of a conventional bucket. A bail easily tears through the corrugated board; and pouring the heavy sealer from a carton without the convenient bail is awkward and generally not acceptable to the consumer.

An object of the present invention is to provide a bucket-like carton having a bail for easy handling.

A further object of this invention is to provide, at a low cost, a carton which has high stacking strength and resistance to breaking and leakage when dropped.

DISCLOSURE OF THE INVENTION

In accordance with one aspect of the present invention, a carton has a generally tubular outer wall with handle hinges extending from opposed segments of the upper edge of the outer wall. A bail is connected to the handle hinges at points above the upper edge of the wall.

In accordance with another aspect of the invention, the handle hinges are flaps folded inwardly to an inner reinforcing wall.

In accordance with yet another aspect of the invention, the inner wall extends substantially the entire height of the outer wall and the two walls are securely and circumferentially fastened to each other near the lower end thereof.

The blank used to form the carton of the present invention includes generally rectangular inner and outer wall portions scored along fold lines. The two wall portions are joined by first and second handle hinge flap portions.

In accordance with a further aspect of the invention, at least one tab extending from the lower edge of the outer wall is folded around the inner wall and around tabs extending from a recessed bottom.

The inner wall portion is as tall as but not as wide as the outer wall portion.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

BEST MODE OF CARRYING OUT THE INVENTION

Figure 1:
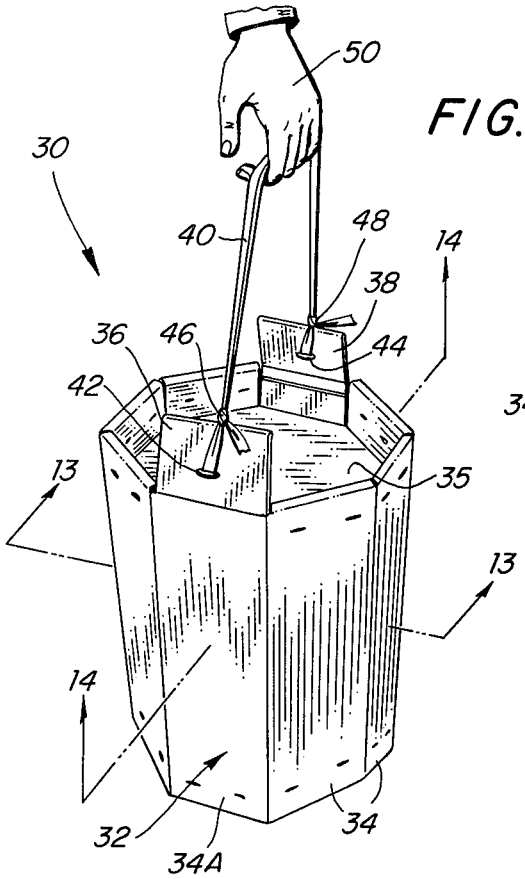
FIG. 1 is a perspective view of a carton embodying the present invention.

A bucket-like carton 30 embodying the present invention is shown in FIG. 1. It includes an outer wall 32 of polygonal cross section having eight sides 34. The driveway sealer is enclosed by a recessed lid 35.

Handle hinges 36 and 38 extend upwardly from opposite sides 34A and 34B of the carton. A ½ inch strap 40 looped through oval holes 42 and 44 in the respective handle hinges is knotted snugly about each hinge by knots 46 and 48. The bucket-like carton may be carried by hand as at 50. During shipping, however, the hinges are folded inwardly toward the recessed lid.

Figure 2:
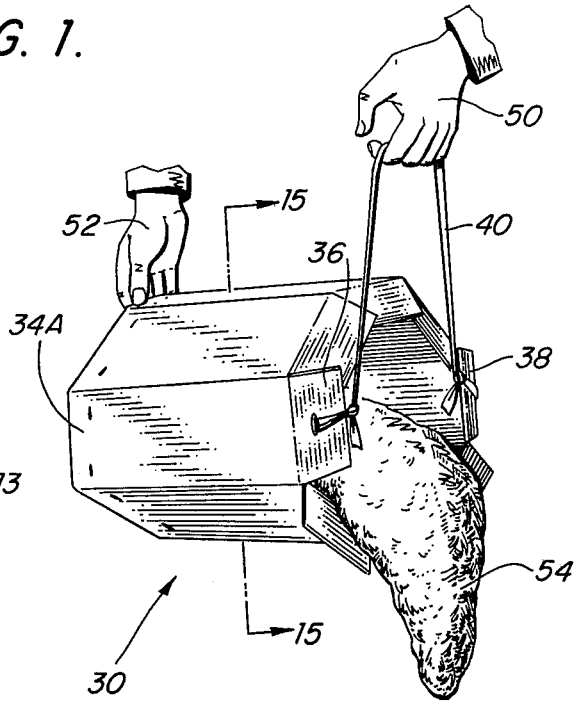
FIG. 2 is a perspective view of the carton of FIG. 1 with sealer being poured therefrom.
Figure 3:
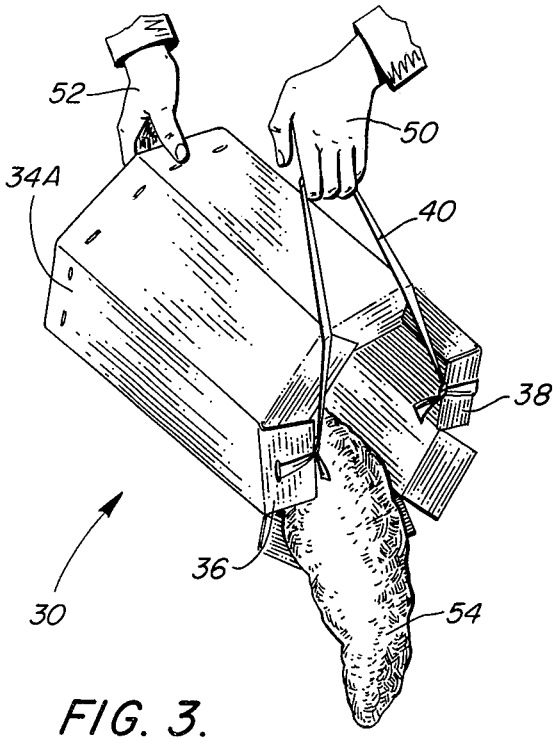
FIG. 3 is a perspective view of the carton of FIGS. 1 and 2 in a more extreme pouring position.

With the lid removed, driveway sealer 54 enclosed in the carton can be poured by grasping a lower rim of the carton below a recessed bottom by a second hand 52 as shown in FIGS. 2 and 3.

Figure 4:
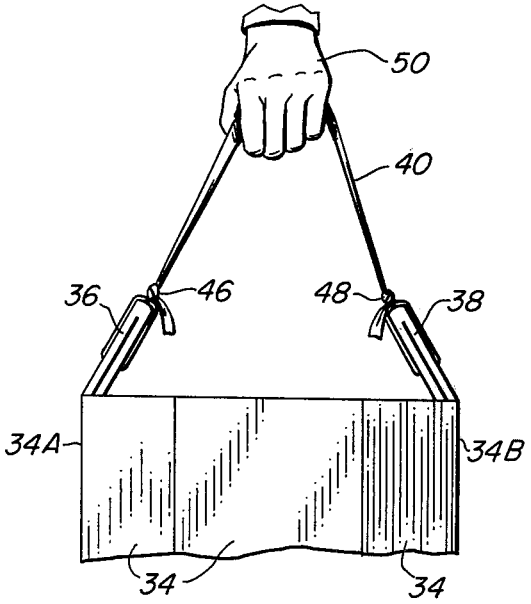
FIG. 4 is a side view of the upper portions of the carton of FIG. 1.
Figure 5:
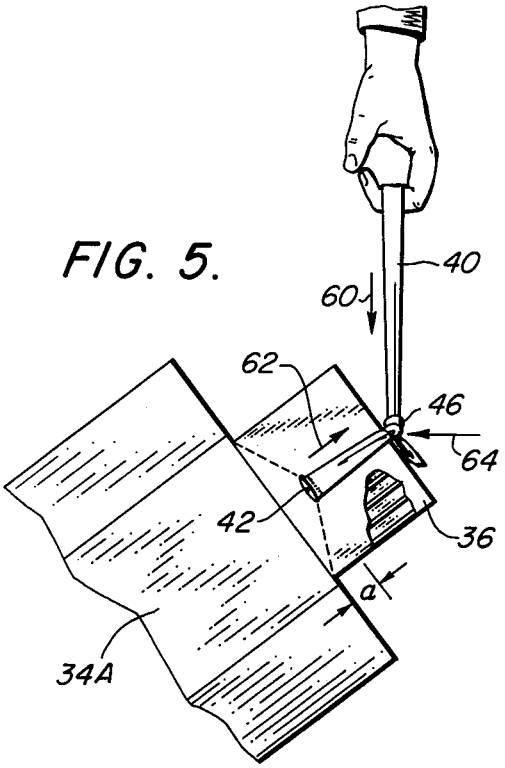
FIG. 5 is a front view of the upper portion of the carton of FIG. 2 showing the forces exerted by the bail strap and the orientation of the strap to the corrugated flutes of the cardboard.

The holes 42 and 44 are spaced above the rim of the carton. And, as shown in the side view of FIG. 4, when the heavy carton is lifted by the strap 40, the handle hinges 36 and 38 bend inwardly at the rim of the carton. The pull from the strap at holes 42 and 44 is in the plane of the hinge. For that reason, there is no tearing action across the plane of the hinge. Also, with the holes 42 and 44 spaced above the rim of the carton, the inward pull across the plane of each side panel 34A, 34B is spread across the entire width of the panel. As shown in FIG. 5, the force from the strap initially exerted only at the hole 42, spreads out along the distance "a" so that transverse tearing forces are absorbed along the entire width of a panel 34A or 34B.

As can also be seen in FIG. 5, the flutes of the corrugated board run vertically. This provides stacking strength along the sides 34 in a coventional manner because the flutes serve as pillars which are not easily compressed. With the present carton those flute pillars also extend into the hinge flaps.

Figure 6:
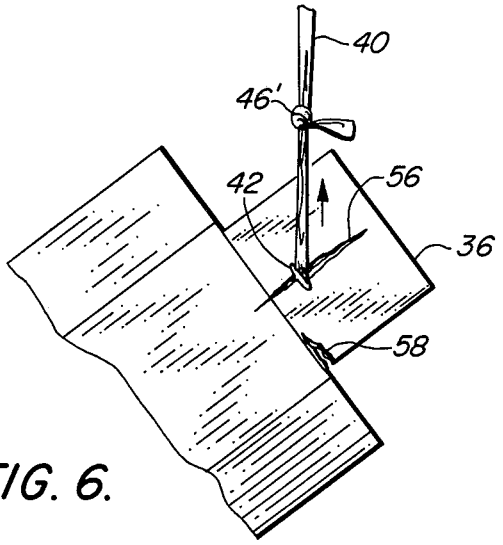
FIG. 6 illustrates the tearing forces to which the hinge would be subjected if the strap were not tightly knotted.

The strap 40 is knotted or otherwise fastened at 46 so that the loop of the strap between knot 46 and hole 42 is pulled snugly about the hinge 36. This snug loop about the hinge flap has two distinct advantages. The first is based on a tendency for the corrugated board to tear in a direction transverse to the pull from the strap 40. If the strap loop were allowed to follow the line of force as shown in FIG. 6, there would be a tendency for the corrugated board to tear along a line 56 parallel to the flutes. This situation is avoided with the present carton because, as shown in FIG. 5, a tear transverse to the pull of strap 40 at hole 42 would run across the flutes, and the flutes are able to resist the tear. Further, if the strap were permitted to shift as in FIG. 6, the force applied in the area of the hole 42 would not be evenly distributed across the entire width of the panel 34A of the carton. The high transverse pull of the flap might lead to a tear 58 where the flap joins the panel 34A, even across the corrugated flutes The arrows in FIG. 5 indicate forces exerted by the strap 40 when sealer is being poured. The weight 60 of the sealer pulls downwardly on the hand through the strap, and an equal force 62 pulls in a line almost parallel to the flutes of the corrugated flap as already discussed. A resultant vector force 64 presses against the fold of the hinge flap. This compressive force is readily resisted by the flap.

Figure 7:
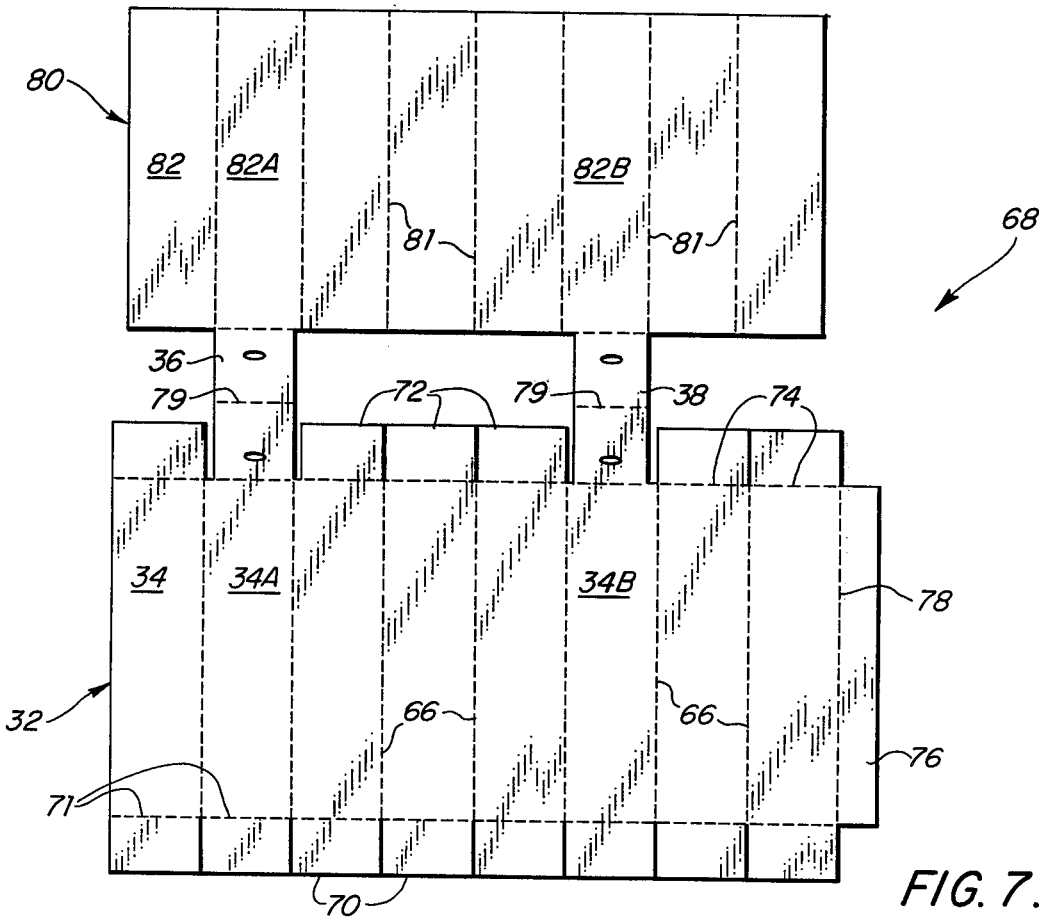
FIG. 7 is a plan view of the corrugated board used to form the outer wall, inner wall and handle hinge flaps.
Figure 8:
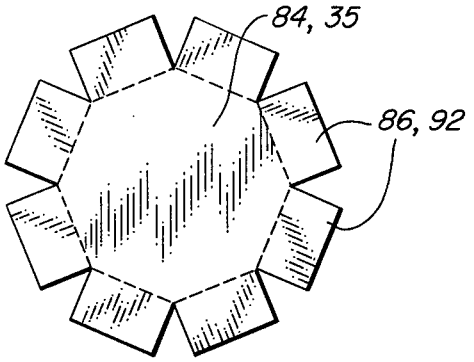
FIG. 8 is a plan view of a stamped blank used for either the bottom or the lid of the carton.

The carton of FIGS. 1–5 is constructed from a first stamped blank 68 of corrugated cardboard for the carton sides (FIG. 7) and two identical stamped pieces of cardboard for the bottom and lid of the carton (FIG. 8). The stamped carton blank of FIG. 7 includes a generally rectangular outer wall portion 32 scored along fold lines spaced along its width to provide eight wall panels. Any other number of panels may alternatively be provided. Eight lower tabs 70 extend from respective side panels 34 and scored fold lines 71 are provided for folding those tabs. Six upper tabs 72 extend from all but two of the panels 34 and are scored along fold lines 74. A connecting tab 76 extends from one end of the outer wall portion 32 and a scored fold line 78 is provided therefor. Two handle hinge flap portions 36 and 38 join the outer wall portion to a generally rectangular inner wall portion 80. The inner wall portion 80 has a number of scored fold lines 81 equal in number to the fold lines 66 on the outer wall portion 32. The handle hinge portions 36 and 38 have scored fold lines 79 at the center thereof.

The carton may be of any size. In a preferred 5.4 gallon carton for carrying 50–55 pounds of driveway sealer, each panel of the outer wall portion 32 is $4\frac{7}{8}$ inches wide to form a wall portion with an entire width of 39 inches. The inner wall portions is about 5% narrower with each panel 82 being $4\frac{5}{8}$ inches wide to form an entire width of 37 inches. The height of each rectangular wall portion is about 18 inches.

Figure 9:
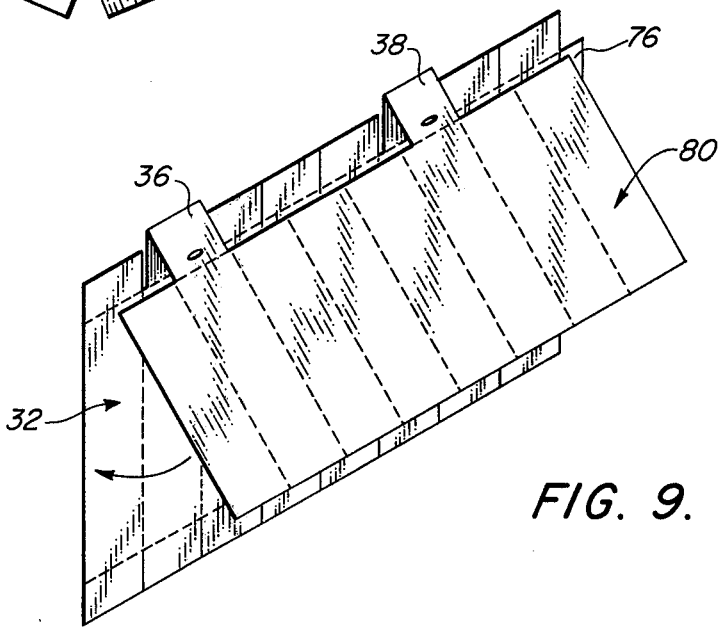
FIG. 9 is a perspective view of the stamped blank of FIG. 7 being folded along the handle hinge flaps.

The stamped blank of FIG. 7 is folded along the fold lines 79 of the hinge flaps as shown in FIG. 9. The resulting two layer sheet of FIG. 10 can then be rolled into an octagonal tube with the tab 76 glued or stapled to the other end of the outer wall portion 32. Because the outer wall then has a slightly greater circumference than the inner wall, the latter is somewhat reduced in width relative to the outer wall portion of the blank as noted above. The term tube is used loosely and is used for any cross-sectional configuration.

Figure 10:
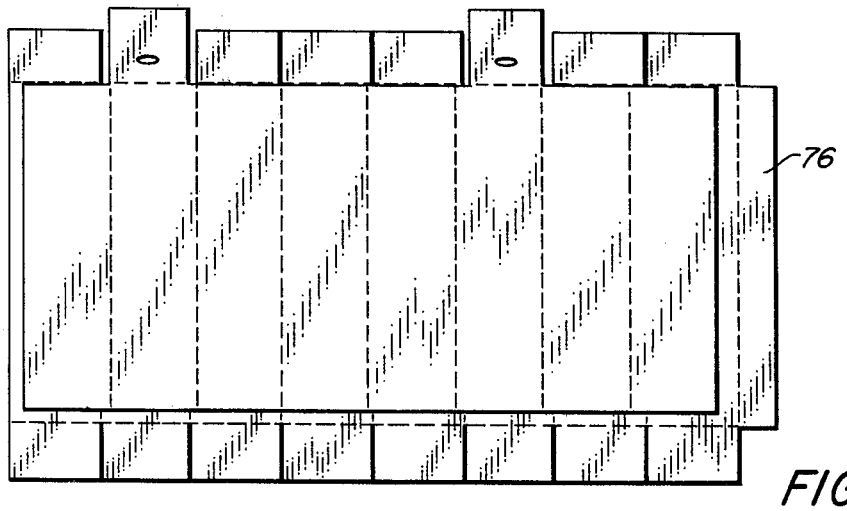
FIG. 10 is a plan view of the blank after the fold of FIG. 9 is completed.

Once the stamped blank of FIG. 10 has been rolled into its generally tubular configuration, the bottom 84 can be inserted into one end thereof. The tube may be held open by a jig, not shown, until the bottom is secure. Also, the bottom 84 may be appended to the blank 68.

Figure 11:
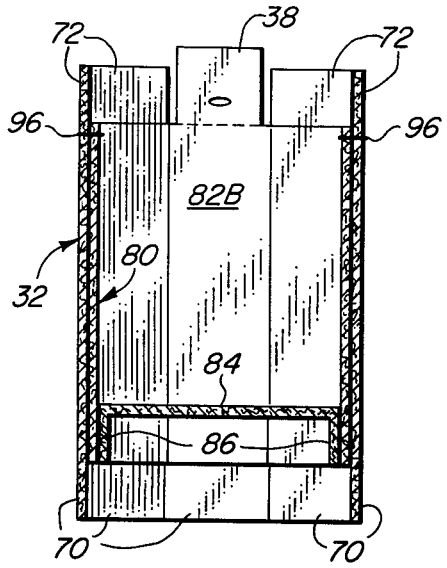
FIG. 11 is an elevational cross-sectional view of the folded blank of FIG. 10 formed into a tube and with a bottom portion of FIG. 8 inserted therein.
Figure 12:
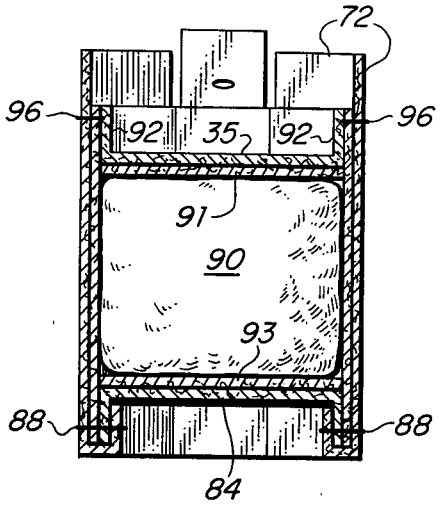
FIG. 12 is an elevational cross-sectional view similar to FIG. 11 but with the lower outer wall tabs folded about the inner wall and the bottom tabs and with a plastic liner of sealer placed in the carton and a lid inserted over the sealer.

As shown in FIG. 11 the tabs 86 of the bottom flank extend downwardly parallel and contiguous with the inner wall 80. Then, as shown in FIG. 12, the lower tabs 70 are folded inwardly around the lower end of the inner wall 80 and around the bottom tabs 86. The resultant four layers are fastened near the lower end of the carton circumferentially by staples 88 or the like.

Driveway sealer can then be set in the carton. In a preferred use of the carton, driverway sealer is enclosed in a vacuum packed liner 90. When set in the carton, the liner is sandwiched between two octogonal pads 91 and 93. These pads allow for some lateral shifting of the liner on the lower pad without rubbing of the liner against the bottom. The pad 93 also offers additional bottom strength.

Although the sealer may later be poured from the carton with the plastic liner still in the carton, in a preferred procedure the plastic liner is removed for mixing. The mixing may be accomplished by kneading the oversized, vacuum-packed liner. Emulsion-type sealer can then be poured directly into the carton. The emulsion-type sealer poured into the carton provides a self-sealing action which prevents leakage from the carton for a short time.

With reference again to the carton construction, after the plastic enclosed sealer is set in the carton the lid 35 is pressed down against the pad 91 tightly to minimize any shifting of the liner during transport. The lid tabs 92 extend upwardly within the inner wall 80.

Figure 13:
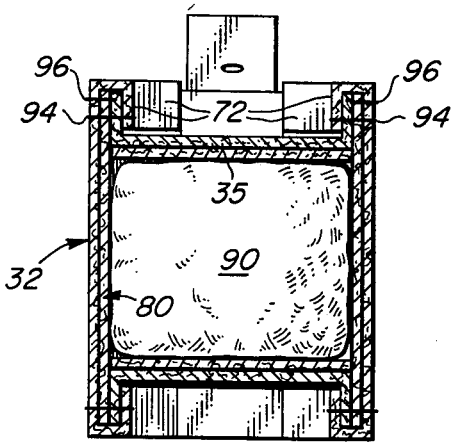
FIG. 13 is an elevational cross-sectional view similar to FIGS. 11 and 12 but with the upper outer wall tabs folded about the inner wall and lid tabs.

Finally, as shown in FIG. 13, the upper tabs 72 from the outer wall are folded inwardly around the inner wall 80 and the lid tabs 92. The resulting four layers are stapled together circumferentially as by staples 94. Because the staples 94 may be removed to remove the lid 35, staples 96 may be used to circumferentially connect the outer wall 32 and inner wall 80 before the lid 35 is placed in the carton (FIG. 11). These staples 96 are not absolutely necessary because the hinge flaps 36 and 38 are joined to both the outer wall 32 and the inner wall 89. Also, the lid could be removed by cutting it along the upper tabs 72. This latter method is not preferred where a plastic inner liner is used.

Figure 14:
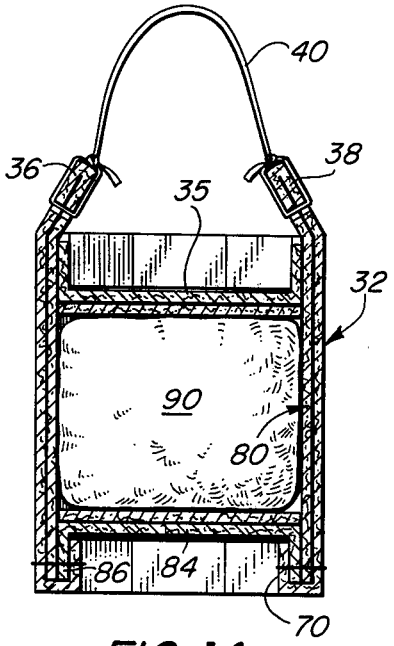
FIG. 14 is an elevational cross-sectional view of the closed carton as in FIG. 13 but showing the flexible bail and handle hinges in section.

The complete carton, with the sealer enclosed and the bail strap 40 attached, is shown in FIG. 14.

It can be seen that the inner wall 80 extends below the recessed bottom 84 of the carton and abuts the fold of the lower tabs of the outer wall 32. This configuration offers several advantages. First, the stacking strength of the carton is maximized because both the outer wall 32 and the inner wall 80 extend from top to bottom providing a double thickness to the weight supporting sides. Also, four layers are provided along the vulnerable lower rim of the carton. These four layers extending below the recessed bottom 84 serve as a shock absorber which can withstand even angled impacts.

Figure 15:
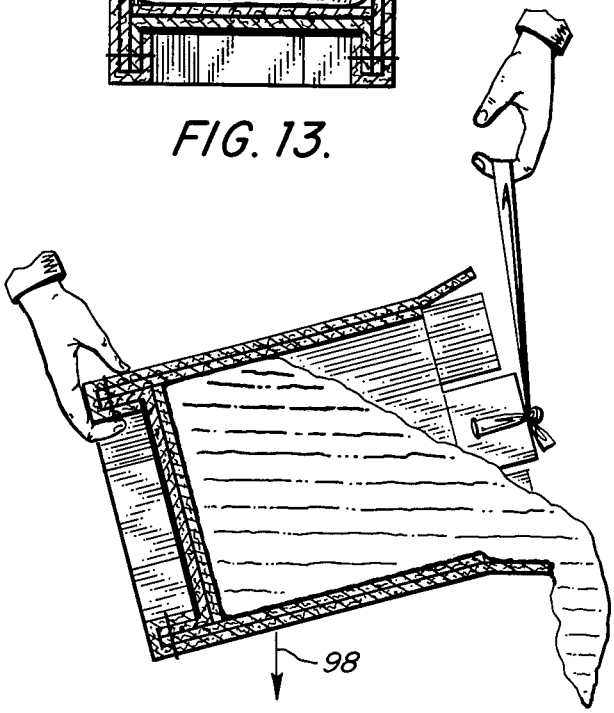
FIG. 15 is a cross-sectional view of the carton with sealer being poured therefrom as in FIG. 2.

A further advantage of the complete inner wall can be recognized from FIG. 15. With the carton grasped and lifted from each end as shown in FIG. 15 the heavy weight of the driveway sealer indicated by vector 98 tends to bend the sides of the carton. With both walls extending into the lower rim of the carton, and with the two fastened together near the bottom of the carton, the two layers jointly resist the bending of the carton sides. It should be recognized that if the inner wall 80 were not fastened to the outer wall near the lower end thereof, it might shift relative to the outer wall and would provide a substantially lesser resistance to bending of the carton sides. The fastened walls also insure that, when the carton is lifted by the handle 40, the weight of the sealer is carried by both walls.

It can be seen in FIG. 14 that the sturdy construction of the carton at its lower rim also provides double support for the bottom 84. The bottom tabs 86 are supported by the fold of the lower tabs 70. Also the lower tabs 70 abut the bottom 84 and provide the second support.

Figure 16:
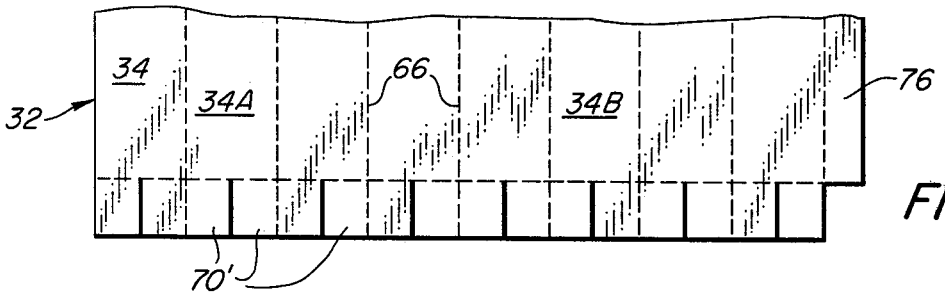
FIG. 16 is a partial plan view of the outer wall portion of the stamped blank showing an alternative configuration of the lower tabs.
Figure 17:
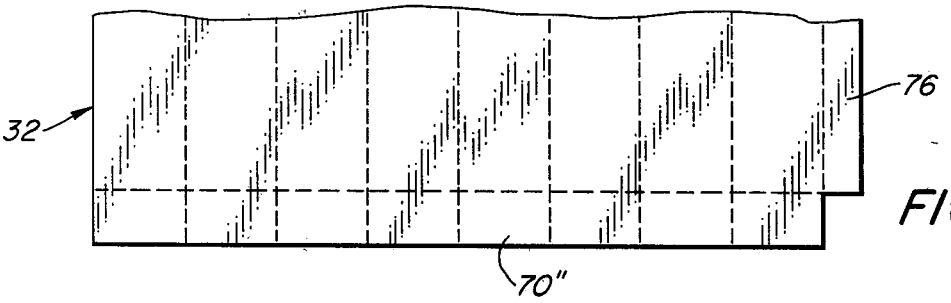
FIG. 17 is a partial plan view similar to FIG. 16 but showing an alternative single lower tab.

Alternatives to the carton thus far described are shown in FIGS. 16–24. FIG. 16 shows lower tabs 70' extending from the outer wall portion 32 of the stamped blank. These tabs 70' are offset relative to the fold lines 66 which define the side panels. With such a configuration, the tabs 70' will also be offset relative to the bottom tabs 86. The result is a labyrinthine path between the tabs for fluid which might tend to leak from the bottom of the container. That path increases the leak resistance of the carton. As a further alternative, a single long tab 70'' (FIG. 17) extending the entire length of the outer wall portion 32 might replace the individual tabs 70 or 70'. Due to the flexibility of the cardboard, the single tab can still be folded around the inner wall and the bottom tabs after the blank has been rolled into its tubular form. Similarly, a single upper tab might replace the tabs 72 between the hinges.

Figure 18:
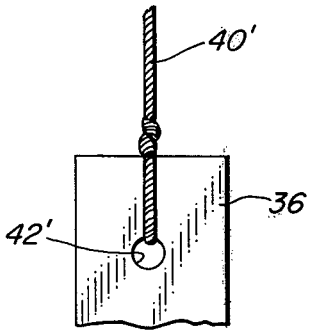
FIG. 18 is a side view of an alternative form of the handle hinge.

FIGS. 18–21 show alternative connections of the flexible bail 40 to the handle hinges. In FIG. 18 the hole 42' is circular rather than in the form of a slit, and a cord 40' replaces the strap 40. The circular hole and the cord are not preferred, however, because they present a risk of only a point contact between the bail and the handle hinge.

Figure 19:
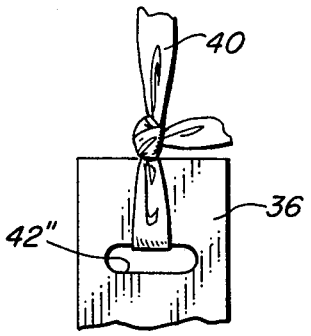
FIG. 19 is a side view of yet another alternative handle hinge.

In FIG. 19, the hole 42'' is sufficiently wide to provide a hand grip. The strap 40 may or may not be used. This widened hole 42'' is particularly suitable for use in a hexagonal carton because of the wider side panels of such a carton.

Figure 20:
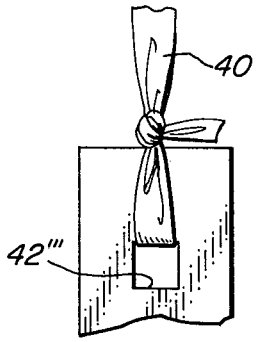
FIG. 20 is a side view of still another alternative handle hinge.

In FIG. 20 a square hole 42''' is provided. This is a preferred configuration because the strap 40 is sure to remain spread across the width of the hole.

Figure 21:
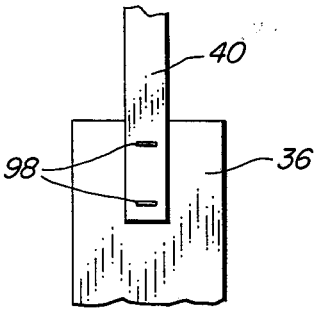
FIG. 21 is a side view of another alternative handle hinge.

In FIG. 21, the strap is stapled to the hinge 36 by staples 98.

A loop in the strap may be formed other than by the knots 46 and 48. For example, a crimped plastic or metal band or staples may secure the strap 40 to itself.

Figure 22:
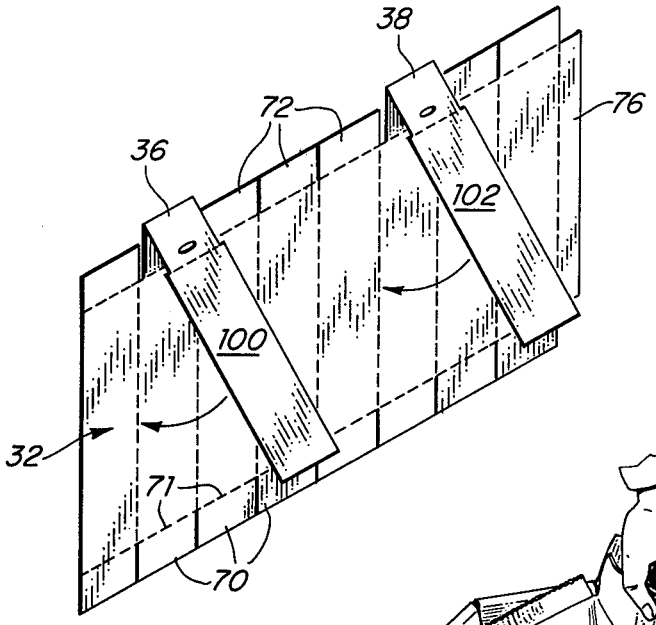
FIG. 22 is a perspective view of an alternative form of the inner wall as the two segments thereof are folded toward the outer wall.
Figure 25:
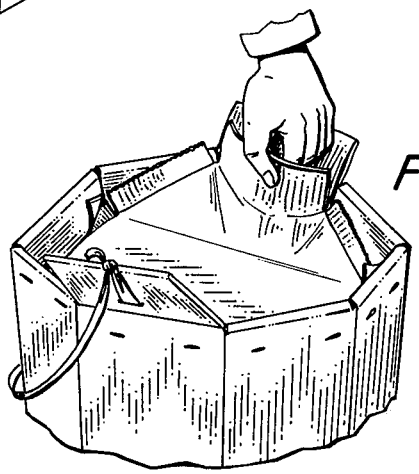
FIG. 25 is a top perspective view of the carton showing the first step in removing the lid of FIG. 23.

FIG. 22 shows an embodiment which may be used where less strength of the carton is sufficient. The handle hinges 36 and 38 are joined to inner wall segments 100 and 102 rather than the common inner reinforcing wall 80. Each of the segments covers a single side panel. Although the segments 100 and 102 may extend only partially down the height of the outer wall portion 32, they preferably extend all the way to the fold lines 71 of the lower tabs 70 for reasons already discussed.

Figure 23:
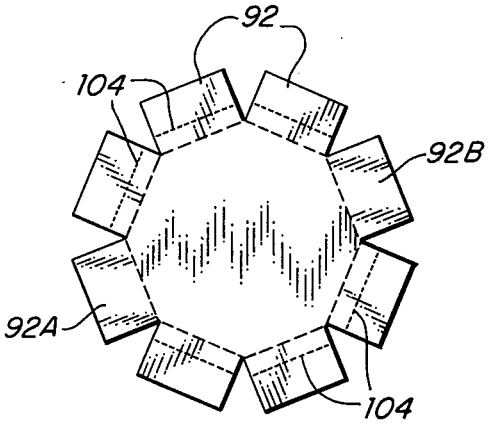
FIG. 23 is a plan view of an alternative lid blank having perforated tabs.

In the embodiments thus far described, to remove the lid 35 the staples 94 must be removed or the lid must be cut. Opening of the carton can be simplified by providing perforations 104 across six of the lid tabs 92 as shown in FIG. 23. The tabs 92A and 92B are not perforated, and in assembling the carton those tabs are positioned adjacent the handle hinges 36 and 38. The perforations are then covered when the upper tabs from the outer wall are stapled into place.

Figure 24:
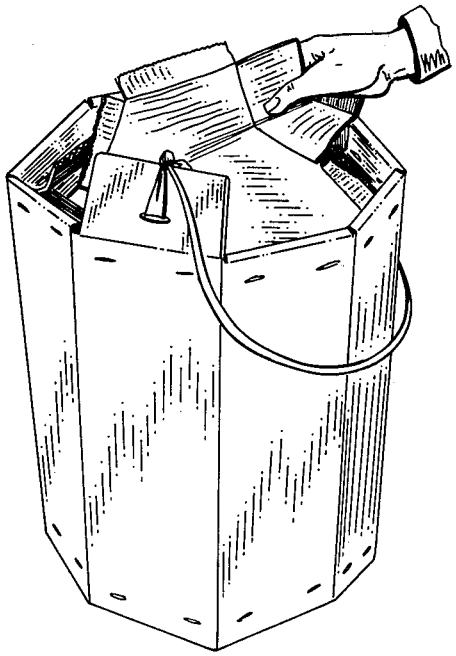
FIG. 24 is a top perspective view of the carton showing the second step in removing the lid of FIG. 23.

Prior to opening of the carton any downward force imposed on the lid is unlikely to cause a tear along the perforations 104 because the lid tabs need only absorb forces in the planes of the vertical tabs. However, by grasping and pulling a tab 92A or 92B one can apply a tearing force to the perforations as shown in FIG. 24. As the tabs are torn along the perforated lines 104, the lid can be pulled from under the upper tabs 72 and can be removed.

While the invention has been particularly shown and described with reference to preferred embodiments thereof, it will be understood by those skilled in the art that various changes in form and details may be made therein without departing from the spirit and scope of the invention as defined by the appended claims.

Industrial Applicability

The carton of this invention has industrial applicability wherever a bucket has been used in the past. It was developed under strict requirements for use with heavy, liquid driveway sealer. It thus has particular utility where a heavy material must be carried and dispensed and where the carton is subject to dropping from heights in the order of three feet or more.

We claim:

1. In a carton having a recessed lid the improvement of the lid having upwardly extending lid tabs parallel to and contiguous with the carton wall, some of the tabs being perforated thereacross and being fastened to the carton wall.

2. The improvement in a carton as claimed in claim 1 wherein at least one tab is not perforated and is available for pulling the lid from the carton.

3. The improvement in a carton as claimed in claim 1 wherein the perforated lid tabs are covered by wall tabs from the carton wall and are fastened to the wall and wall tabs.

4. The improvement in a carton as claimed in claim 3 wherein each perforated lid tab is perforated along a line spaced outwardly from the lid.

5. A carton comprising:

a generally tubular outer wall;

an inner reinforcing wall, extending substantially the entire height of the outer wall;

at least two hinge flaps extending upward from the outer wall, each hinge flap being folded inward to the inner wall;

a flexible bail attached to each hinge flap;

a recessed bottom;

bottom tabs extending downward from the bottom, parallel to and contiguous with the inner wall; and at least one lower tab extending from the lower edge of the outer wall, the at least one lower tab being folded inward and in overlapping relationship with the lower end of the inner wall and with the bottom tabs, and the outer wall, inner wall, bottom tabs and lower tabs being fastened together.

6. A carton as claimed in claim 5 wherein each handle hinge has a hole therein spaced above the upper edge of the outer wall, and the flexible bail is looped through the hole tightly about the hinge.

7. A carton as claimed in claim 5 wherein the hinge flaps are folded inwardly to a common inner reinforcing wall.

8. A carton as claimed in claim 5 wherein a lid to the carton is recessed and upper tabs extending from the outer wall overlap lid tabs extending upward from the recessed lid.

9. A carton as claimed in claim 8 wherein some of the lid tabs are perforated thereacross.

* * * * *